United States Patent [19]

Roming

[11] Patent Number: 4,603,688

[45] Date of Patent: Aug. 5, 1986

[54] MASSAGE APPARATUS

[76] Inventor: Helmut Roming, Linberg 27, D-7230 Schramberg 11, Fed. Rep. of Germany

[21] Appl. No.: 684,612

[22] Filed: Dec. 21, 1984

Related U.S. Application Data

[62] Division of Ser. No. 339,148, Jan. 13, 1982, Pat. No. 4,498,493.

[30] Foreign Application Priority Data

Jan. 20, 1981 [DE] Fed. Rep. of Germany ..... 3101538

[51] Int. Cl.[4] ..... A61H 15/00

[52] U.S. Cl. ..... 128/37; 128/53; 128/55; 128/57

[58] Field of Search ..... 128/24.1, 24.3, 35–38, 128/47, 54–56, 53, 57

[56] References Cited

U.S. PATENT DOCUMENTS

| | | | |
|---|---|---|---|
| D. 262,908 | 2/1982 | Pesco | D24/36 |
| D. 273,708 | 5/1984 | Haug . | |
| 1,038,656 | 9/1912 | Reutler | 128/66 |
| 1,088,242 | 2/1914 | Rudolph | 128/53 |
| 1,101,804 | 6/1914 | Lauter | 128/37 X |
| 1,579,679 | 4/1926 | Wahrt | 128/54 |
| 1,635,917 | 7/1927 | Wright | 128/55 |
| 2,159,096 | 5/1939 | Mitchell | D24/36 X |
| 2,285,105 | 6/1942 | Laszlo | 128/56 |
| 2,290,454 | 8/1942 | Steinberg . | |
| 2,683,451 | 7/1954 | Clark | 128/24.1 |
| 2,895,469 | 7/1959 | Regley | D24/36 X |
| 2,905,171 | 5/1958 | DeCrescenzo . | |
| 3,720,204 | 3/1973 | Wojtowicz | 128/66 |
| 3,994,290 | 11/1976 | Springer et al. . | |
| 3,998,390 | 12/1976 | Peterson et al. | 128/66 |
| 4,116,233 | 9/1978 | Scaduto . | |
| 4,274,400 | 6/1981 | Baus . | |
| 4,326,508 | 4/1982 | Stauffer | 128/57 |
| 4,498,463 | 2/1985 | Roming | 128/37 |

FOREIGN PATENT DOCUMENTS

| | | | |
|---|---|---|---|
| 168576 | 6/1951 | Austria | 128/57 |
| 1143886 | 10/1957 | France . | |
| 1249098 | 11/1960 | France . | |
| 1270620 | 7/1961 | France | 128/57 |
| 1286023 | 1/1962 | France | 128/57 |
| 651965 | 6/1963 | Italy | 128/57 |

*Primary Examiner*—Clyde I. Coughenour
*Attorney, Agent, or Firm*—Steele, Gould & Fried

[57] ABSTRACT

A water pressure driven massage apparatus has a casing carrying a plurality of captive massage members in the form of balls. The balls are mounted in guide passages with some clearance to move inwardly and outwardly with respect to the casing. When the device is pressed against a body part to be massaged, the balls are pushed back against an eccentric projection on a water-driven turbine, causing them to follow a periodic massaging stroke. When not pressed against a user, the balls are forced by water pressure to an outermost position at which the guide passages are sealed by the balls against flow and the water then passes through spray jet guides are provided in the surface of the casing.

15 Claims, 3 Drawing Figures

MASSAGE APPARATUS

CROSS-REFERENCE TO RELATED APPLICATIONS

This is a division of application Ser. No. 339,148, filed Jan. 13, 1982, now U.S. Pat No. 4,498,493.

BACKGROUND OF THE INVENTION

The invention relates to a massage apparatus with a casing, at least one movable massage member projecting from the working surface of the casing and exercising the massage action, a water connection and a drive mechanism for the massage member with a water turbine rotating on an axis.

Massage apparatus in which in each case a rotary brush ring is driven by means of a water turbine are known e.g. from German Offenlegungsschrift No. 26 34 772, German Offenlegungsschrift No. 25 05 969 and German Utility Model 75 41 260.The problem exists with said known massage apparatus that the driving torque exerted on the massage brush is not adequate to effectively rotate the brush, if the brush is driven directly by the turbine, i.e. without any gearing down. Reduction gears have gear wheels in the water area and therefore tend to be subject to calcification. In the case of the massage apparatus according to German Utility Model 75 41 260 the turbine is provided with an eccentric engaged by a fork radially connected to the rotor brush shaft. The rotary movement of the turbine is converted into a reciprocating, periodic oscillating movement of the massage brush, which follows a limited path. The oscillating movement can be superimposed with axial movements of the brush cooperating projections being provided on the rotor brush and on the outside of the casing facing said brush. In addition, the known massage apparatus can only be used as an alternative to a normal spray because the working surface taken up by the rotating brush is not available for producing spray jets and for the formation of the spray jets a switching-over process is always required.

Apparatus also exist, which are constructed in the manner of a spray head and in which the movement of the massage member is brought about by means of a flexible shaft through the water supply hose and corresponding gears in the spray head. However, such apparatus are complicated and are therefore out of the question for inexpensive mass production.

BRIEF SUMMARY OF THE INVENTION

The object of the invention is to provide a water-drivable massage apparatus with a good mechanical massaging action, which is easy to operate, simply constructed and also usable as a hand-held spray.

According to the invention this object is achieved in that a plurality of independent members is provided, the massage members being driven by a water turbine rotating around an axis, and each massage member being individually captive in the casing with clearance to move parallel to the turbine axis. On the side of the water turbine facing the massage members, the water turbine has at least one eccentric projection for producing the axial movement of the massage members.

Unlike the case of the rotary brushes of the known massage apparatus, the massage members of the apparatus according to the invention are individually and substantially exclusively axially moved or driven. Thus, the massage movement consists of impact of the massage members directly toward the part of the body to be massaged. Therefore the massage members are not generally constructed as brushes and instead preferably have a closed and, in particular, rounded surface. As the massage movement takes place in a pressing rather than a rubbing manner, there are no friction losses, so that the driving force of the turbine can be fully utilized for the massage movement. The turbine is preferably a Pelton turbine.

The projection or projections on the turbine directly cooperate with the massage members whilst producing the axial movement and this particularly applies if the projections are in the form of radial shafts or ribs.

The axial movements of the individual massage members arranged about the turbine axis are out of phase with one another due to the circular movement of the eccentric projection on the turbine, which means that during the massage process only some of the individual balls are pressed at one time in the direction of the body to be massaged. Therefore, the masses moved at one time are low, which again permits increased utilization of the driving force. In addition, the span of axial movement of the massage member or members located further from the turbine axis is preferably greater than that of the massage member or members located closer thereto. This makes it possible to vary the massage action by the selective application of the more central massage member or members or the member or members located further towards the outside.

According to a preferred embodiment of the invention the clearance or span of the massage members is dimensioned such that the drive only engages the massage member on the members being pushed back from their outermost position remote from the turbine. In other words, the turbine or drive remains free of the massage bodies and essentially idles so long as the massage members are in their outermost position. However, when the massage apparatus is pressed against the part of the body to be massaged, the massage members are then pressed inward from their outermost position and engaged by the drive. The axial stroke of the massage members continues to increase as they are raised further from their outermost position on pressing harder against the part of the body to be massaged. Therefore, the movement of the massage bodies is greatest when the device is pressed hardest against the user. The stroke of the axial movement exerted by the massage members is preferably in the range of 2 to 10 and most advantageously 4 to 7 mm.

The massage members are captive in bores in the casing, and are preferably dimensioned to function as valve bodies when in their outermost position remote from the turbine. The massage members substantially seal the extreme ends of the bores in the casing at the outermost position. As a result the water flow through the boxes is greatly restricted when the massage apparatus is raised from the body to be massaged and the water pressure forces the massage members into their outermost sealing position. It is particularly advantageous for the massage apparatus to have additional spray jet orifices in the vicinity of the working surface. As a result of these additional orifices a pressure relief is obtained within the massage apparatus, making the massage members easier to press back from their outermost position. Moreover, an automatic switch-over of the massage apparatus from the massage function to a spray function is thereby achieved because when the apparatus is raised from the part of the body to be massaged, the openings for the massage bodies are sealed and the water pressure devoted to the spray. Thus, there is no need for separate switching processes, as are required in the case of known massage apparatus which can be used as sprays. Friction can be reduced in that the massage members are constructed and mounted so that they can rotate about themselves, while captive in the bores in the casing. In particular, the massage members can roll over transverse axes perpendicular to the turbine axis. This is the case if the massage members are constructed in a cylindrical and preferably spherical manner.

The projection on the water turbine directed towards the massage members can be constructed as a surface inclined towards the rotation plane of the turbine. In other words, the surface provides an inclined surface or ramp extending in a direction parallel to the turbine axis, whereby the surface drives the massage members outwardly of the working surface in a direction parallel to the turbine axis as the turbine rotates. The inclined surface or ramp preferably drops from its highest point in the direction of the turbine axis. The inclined surface can be constructed as a sloping ring coaxial to the turbine axis. It is particularly advantageous if the drive of the massage member according to the invention is free from any positive-engaging transmission means, as is the case in the above described embodiments. If transmission means becomes disengaged when the massage members are in their outermost position remote from the turbine, then the pressure loss in the massage apparatus when it is operating as a spray is extremely low because the turbine idles with the water flow and as a result the spray is not impaired.

The massage apparatus casing is appropriately substantially cylindrical and preferably the diameter of the working surface occupied by the massage members substantially corresponds to the turbine diameter. The water connection can direct flow radially and/or axially into the casing. In the case of a preferred embodiment the casing is provided with a handle directed away from the working surface and the handle can be connected to allow relative rotation of the handle and the casing. On the side of the casing directed away from the working surface it is also possible to provide a rotary cover to which a handle is fixed. The handle is appropriately constructed as a bow-shaped handle, the width and height of the bow being such that a flat hand can be inserted between the bow and the cover for gripping the casing. As a result of the rotatability of the handle relative to the casing, the massage apparatus does not become entagled in the water supply hose.

BRIEF DESCRIPTION OF THE DRAWINGS

Th invention is described in greater detail hereinafter relative to non-limitative embodiments and the attached drawings, wherein.

DETAILED DESCRIPTION OF THE PREFERRED EMBODIMENTS

Figure 1:
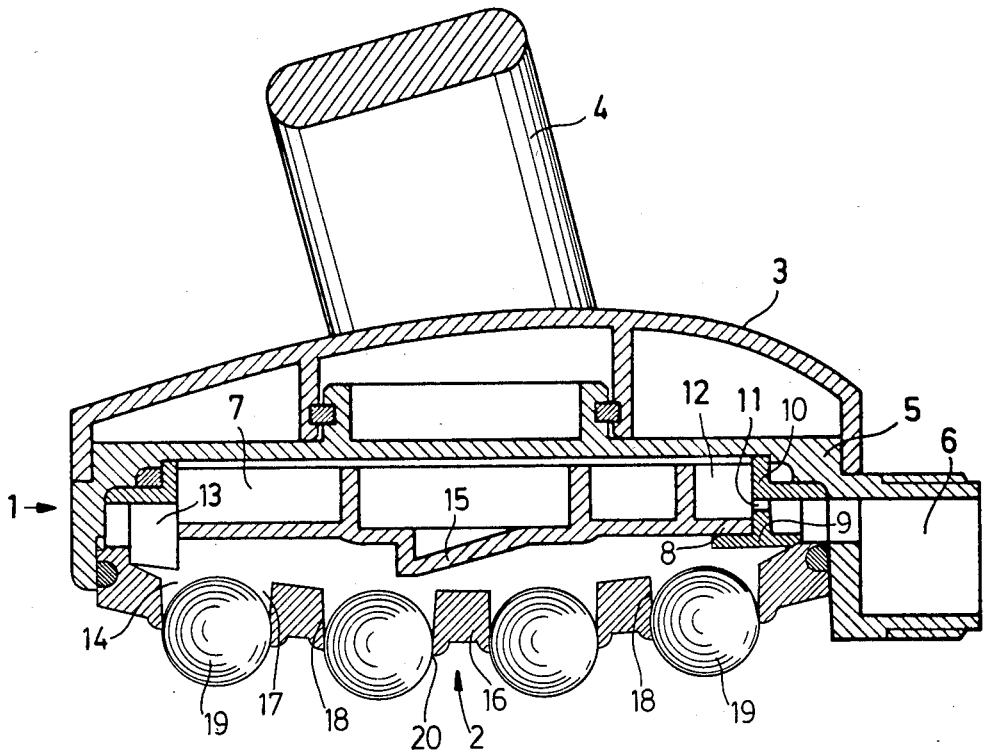
FIG. 1 is a section through an embodiment of the invention.
Figure 2:
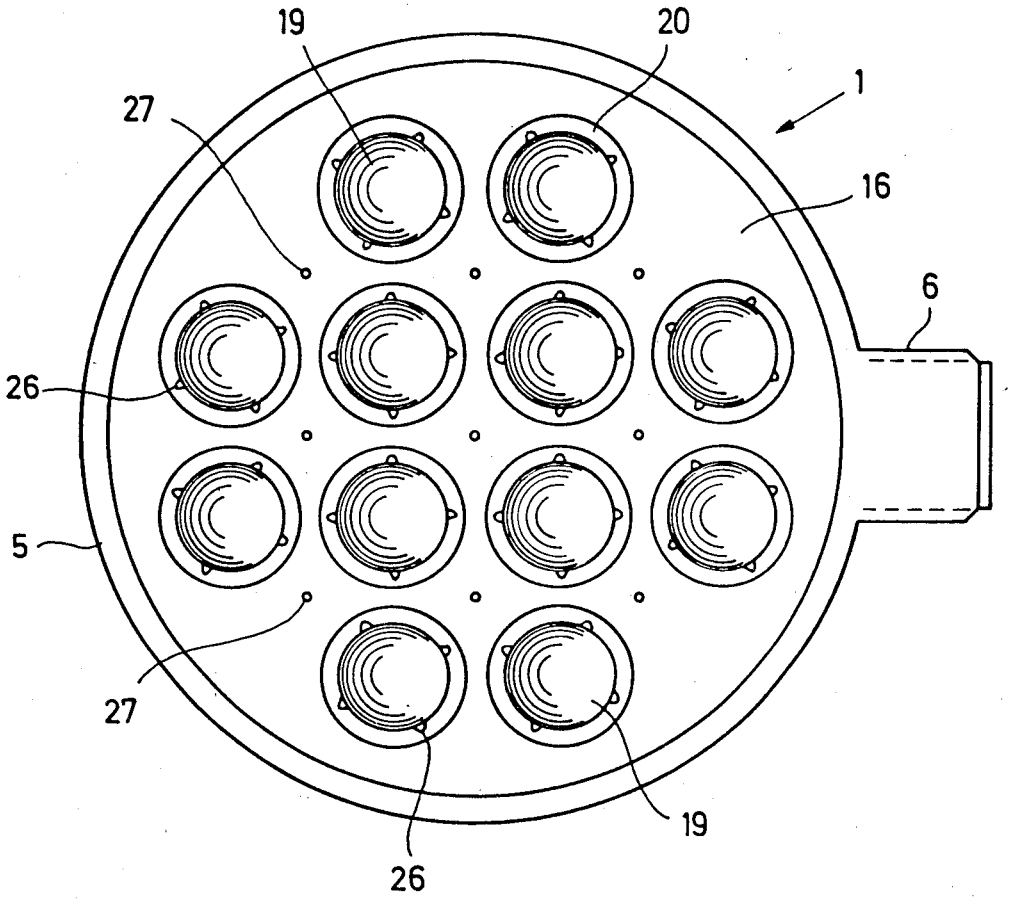
FIG. 2 is a view from below of this embodiment.

In the embodiment shown in the drawing the massage apparatus has a substantially flat cylindrical casing 1 having on one side a working surface 2 and on the opposite side a cap-shaped handle casing 3. The handle casing is axially fixed and freely rotatable with respect to the apparatus casing 1 and has a flat bow-shaped handle 4, which is constructed so as to permit the insertion of a flat hand.

The part of the apparatus casing 1 connected to the handle casing 3 is a dome-shaped turbine casing 5 closed on the handle side and provided with a radial water feed connection 6 having a standard thread. A Pelton turbine 7 open towards the handle side and closed towards working surface 2, is mounted in overhung manner in turbine casing 5 supported by its outer edge 8 directed towards working surface 2 on three bearing surfaces 9 (only one is shown). Surfaces 9 are defined by a feed member 10 inserted in turbine casing 5. Between feed member 10 and turbine casing 5 is provided an annular channel, which communicates with feed connection 6 and from which lead three bores 11 for supplying turbine blades 12. The water outlet from the turbine blades 12 takes place by means of recesses 13 in feed member 10 in an area 14 of casing 1 located between turbine 7 and working surface 2. Into the said area projects an eccentric projection 15 of turbine 7, which may be constructed as an axial, central cylinder end with a chamfered end face. The eccentricity of projection 15 is approximately 1/5 to 1/6 of the turbine radius and the slope of the surface, which here substantially corresponds to the height of projection 15, is approximately 1/10 of the turbine radius.

The working surface 2 of the massage apparatus is formed by a base plate 16, which has ten openings 17 with tubular guides 18 for balls 19 serving as massage members. Guides 18 allow balls 19 to move freely over a range between their outermost position as shown in FIG. 1, and inner positions along lines parallel to the turbine axis, laterally spaced from the turbine axis around working surface 2. The edges 20 of openings 17 project somewhat from working surface 2 edges 20 and are slightly narrower than the diameter of guides 18, so that the balls 19 are captive and cannot drop out of guides 18 in their outermost position, at which the balls substantially close and seal openings 17.

When the balls 19 remain in their outermost position as shown in FIG. 1, projection 15 does not engage the balls 19. As the balls are pushed inwardly by contact with a body part to be massaged, projection 15 is engaged, and causes individual balls 19 to move outwardly as projection 15 passes them. The span of axial displacement of balls 19 increases in proportion to the extent that the individual ball is pressed inwardly again by the body part, following the pressing outwardly of the ball caused by inclined projection 15.

In the case of limited contact pressure the balls 19 are only slightly raised from their inoperative or end position and are forced back by turbine 7 via the inclined surface of projection 15 and transmission plate 21. This leads to only a limited deceleration of turbine 7 and there is a high pulsation frequency for each individual ball. The balls also move only slightly along guides 18. In the case of a higher contact pressure, there is a greater lifting action, as well as a longer axial distance needed to move balls 19 to allow projection 15 to pass. Therefore, the turbine 7 becomes slower due to the higher resistance and an intensive massaging effect is obtained with a lower pulsation frequency, but a longer stroke and very definite massaging action.

Figure 3:
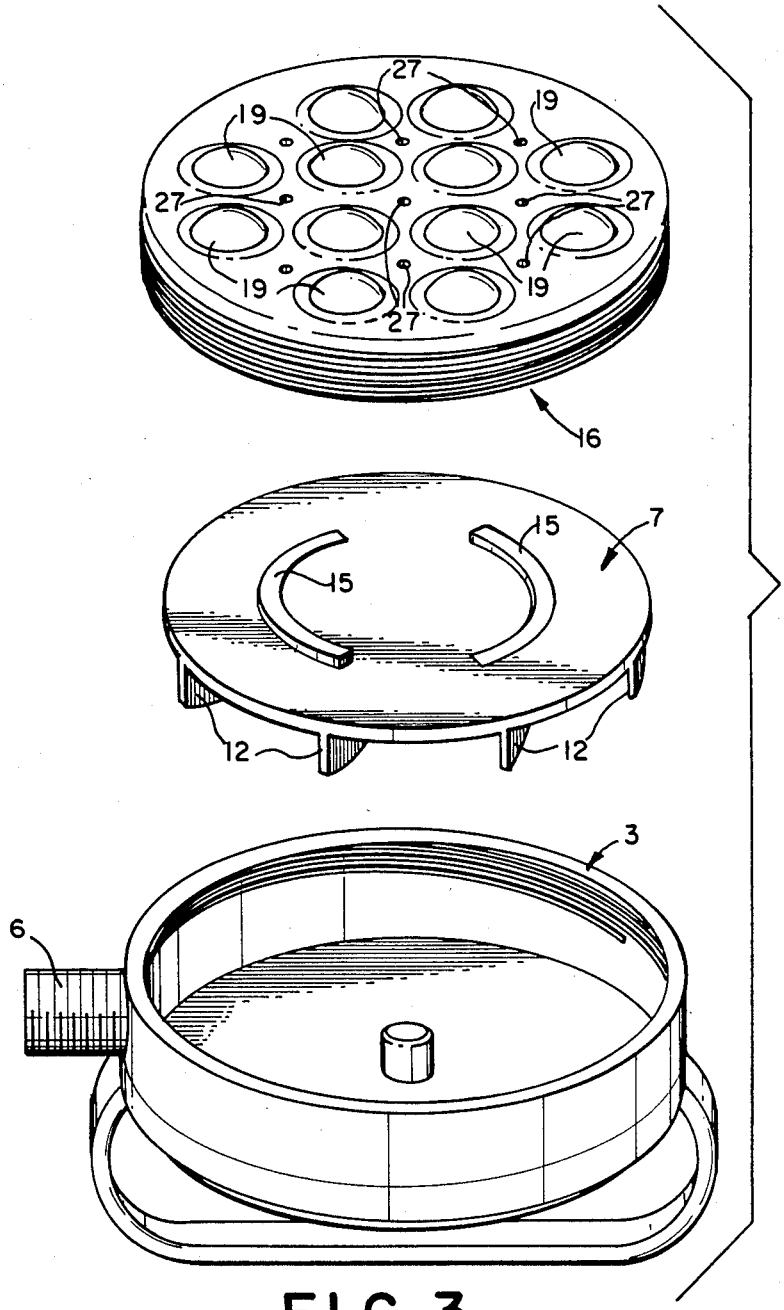
FIG. 3 is an exploded perspective view of another preferred embodiment.

As shown in FIG. 3, the projection 15 can define at least one ring coaxial to the turbine axis, inclined toward the rotation plane of the turbine. The projection can also comprise radial ribs. As the projection passes an individual ball during rotation of the turbine, the ball is forced axially outwards by projection 15. Projection 15 defines the outermost driven position of balls 19; the innermost position of balls 19 is determined by the extent to which they are pushed inwardly against the water pressure by contact with a body part to be massaged. The axial span of movement of balls 19, namely the difference between these innermost and outermost positions, varies with the extent to which the device is pressed against the body part. Due to the limited gradient of the inclined surface of projection 15 and the limited friction radius of the circular path along the inclined surface, the transmission losses are kept very low. Furthermore, the overhung mounting of transmission plate 21 ensures that it is not possible to stop rotation of turbine 7 by a too high contact pressure on one side.

The water flowing into area 14 flows through the water outlets 22 into the ball guides 18 which, on their insides, can be provided with spray jet guidance grooves 26 cooperating with balls 19 and then past the balls and through the openings 17 in base plate 16. Base plate 16 also has jet-forming bores 27 through which the water passes out as a spray jet, particularly when the openings 17 are sealed by the balls moving to their outermost position. In this position the turbine idles and produces no pressure loss, so that the spray jets can pass out in conventional manner. As a result of the slight curvature of base plate 16 of the massage apparatus, the operation of the latter is facilitated.

What is claimed is:

1. A massage apparatus, comprising:

a casing having a water turbine, the casing having means for attachment to a supply of water for rotating the turbine about an axis, the casing having a working surface with a plurality of openings arranged laterally around said axis, the openings permitting passage of water, the turbine having at least one eccentric projection with an inclined surface directed toward the working surface; and, a plurality of spherical massage bodies mounted at the openings in the working surface and laterally spaced around the axis defined by rotation of the turbine, the massage bodies being captive in the working surface and individually moveable over a stroke parallel to said axis, the stroke including a range of positions inwardly from an outermost position at which the massage bodies substantially seal the openings from passage of the water, the bodies being urged outwardly by water pressure and urged inwardly by contact with a body part to be massaged whereupon the water passes the massage bodies, and the massage bodies being axially driven outwardly by contact with the eccentric projection when moved inwardly from said outermost position, the massage bodies cooperating directly with the inclined surface of the at least one eccentric projection of the turbine.

2. A massage apparatus according to claim 1, wherein the massage members engage with the eccentric projection only on moving out of an outermost position in said axial stroke and at said outermost position are free of the projection.

3. A massage apparatus according to claim 1, wherein the axial stroke of the massage members is 2 to 20 mm.

4. The apparatus of claim 3, wherein the axial stroke is 4 to 7 mm.

5. A massage apparatus according to claim 1, wherein the working surface of the casing has water outlets, defining spray jet guides adjacent the openings in the working surface.

6. A massage apparatus according to claim 1, wherein the individual massage members are rotatable along the working surface.

7. A massage apparatus according to claim 1, wherein the water turbine projection has a surface inclined towards a plane of rotation of the turbine, which slopes down from a highest point on said surface towards the turbine.

8. A massage apparatus according to claim 1, wherein the turbine is free of direct connection with the massage bodies.

9. A massage apparatus according to claim 1, wherein the casing is substantially cylindrical, the working surface having a diameter corresponding substantially to the diameter of the turbine.

10. A massage apparatus according to claim 1, wherein on a side directed away from the working surface the casing has a handle connected with the casing and wherein the handle is rotatable with respect to the casing.

11. A massage apparatus according to claim 1, wherein on a side of the casing directed away from the working surface the casing has a cover portion relatively rotatable with respect to the casing, and further comprising a handle fixed to the cover portion.

12. A massage apparatus according to claim 11, wherein the handle has a bow-shaped construction spaced from the cover to permit insertion of a flat hand between the handle and the cover.

13. The apparatus of claim 1, comprising a plurality of eccentric projections.

14. The apparatus of claim 13, wherein the projections are in a form of radial ribs.

15. The apparatus of claim 1, wherein the projection includes a sloping ring coaxial to the axis of the turbine.

* * * * *